US010105662B1

(12) United States Patent
Mattson et al.

(10) Patent No.: US 10,105,662 B1
(45) Date of Patent: Oct. 23, 2018

(54) MIXING SYSTEMS, METHODS, AND DEVICES WITH EXTENDIBLE IMPELLERS

(71) Applicants: Bayer CropScience LP, Research Triangle Park, NC (US); Reliance Products Ltd., Winnipeg (CA)

(72) Inventors: Doug Mattson, Liberty, MO (US); Mark Smith, Lees Summit, MO (US); Neil Scott, Excelsior Springs, MO (US); Ryan Bergman, Olive Branch, MS (US); Ron Renkel, Southhaven, MS (US); Glenn Bartlett, Winnipeg (CA); David Beernaert, Winnipeg (CA)

(73) Assignee: BAYER CROPSCIENCE LP, Research Triangle, NC (US)

( * ) Notice: Subject to any disclaimer, the term of this patent is extended or adjusted under 35 U.S.C. 154(b) by 0 days.

(21) Appl. No.: 15/846,549

(22) Filed: Dec. 19, 2017

(51) Int. Cl.
*B01F 7/00* (2006.01)
*B01F 7/22* (2006.01)
*B01F 3/08* (2006.01)

(52) U.S. Cl.
CPC ..... *B01F 7/00058* (2013.01); *B01F 3/0853* (2013.01); *B01F 7/00291* (2013.01); *B01F 7/00691* (2013.01); *B01F 7/22* (2013.01); *B01F 2215/0009* (2013.01)

(58) Field of Classification Search
CPC ..... B01F 7/00058; B01F 7/00291; B01F 3/0853; B01F 7/22; B01F 7/00691; B01F 2215/0009
USPC ..... 220/601
See application file for complete search history.

(56) References Cited

U.S. PATENT DOCUMENTS 3,405,643 A * 10/1968 Berman ..... B05B 9/0409 184/29
4,264,215 A 4/1981 Nunlist et al.
4,491,421 A 1/1985 Koehl et al.
4,635,814 A 1/1987 Jones
4,856,683 A * 8/1989 Beaston ..... A01M 7/0089 222/318
4,934,551 A * 6/1990 Budenbender ..... B65D 7/40 220/601
5,184,751 A * 2/1993 Middleton ..... B67D 7/0288 141/334

(Continued)

FOREIGN PATENT DOCUMENTS

CN 2782204 Y 5/2006
CN 2803502 Y 8/2006

*Primary Examiner* — Charles Cooley
(74) *Attorney, Agent, or Firm* — McBee Moore Woodward & Vanik IP, LLC; Susan McBee

(57) ABSTRACT

A mixing assembly includes a drum including a side wall, a top portion, and a bottom portion, in which the top portion includes a first opening for filling a substance into the drum, a second opening for mixing the substance in the drum, and a third opening for extracting the substance from the drum; and a mixer releasably disposed in the drum, including a head releasably attached to the second opening for mixing, in which the head includes a housing including an internal hollow region extending along the central axis of the head, and external threads configured to be attached to the second opening for mixing by thread engagement, a shaft disposed in the hollow region, and an impeller assembly disposed at a bottom end of the shaft for stirring the substance in the drum.

18 Claims, 10 Drawing Sheets

(56) References Cited

U.S. PATENT DOCUMENTS 5,193,908 A * 3/1993 Rescorla ..... B01F 7/24 261/119.1
5,351,850 A 10/1994 Brieskorn
5,362,148 A * 11/1994 Lehrke ..... B01F 7/24 366/191
5,402,909 A * 4/1995 Cramer ..... B65D 1/20 220/601
5,489,151 A * 2/1996 Weber ..... B01F 7/0005 366/247
5,908,240 A 6/1999 Hood
5,984,133 A * 11/1999 Schutz ..... B65D 1/16 206/509
6,047,846 A * 4/2000 Watson ..... B65D 1/16 220/4.04
6,216,907 B1 4/2001 Morneau
6,223,930 B1 * 5/2001 Watson ..... B65D 1/16 220/4.04
D543,004 S 5/2007 Pomilia
D548,423 S 8/2007 Pomilia
D548,424 S 8/2007 Pomilia
D548,425 S 8/2007 Pomilia
8,408,418 B2 * 4/2013 Kuzelka ..... B01F 15/00006 220/600
8,523,003 B2 * 9/2013 Kunieda ..... B65D 11/06 220/4.05
9,074,171 B2 7/2015 Gueneron
9,713,799 B2 * 7/2017 Mattson ..... B01F 7/00058
2004/0089667 A1 * 5/2004 Gargano ..... F16L 55/1108 220/601
2004/0208081 A1 * 10/2004 Hughes ..... B01F 7/161 366/191
2005/0088907 A1 * 4/2005 Vanek ..... B01F 7/00075 366/129
2010/0195432 A1 8/2010 Laurence et al.
2014/0255575 A1 9/2014 Bhushan et al.
2015/0165396 A1 * 6/2015 Mattson ..... B01F 7/00058 366/279
2017/0266632 A1 * 9/2017 Mattson ..... B01F 7/00058

* cited by examiner

MIXING SYSTEMS, METHODS, AND DEVICES WITH EXTENDIBLE IMPELLERS

FIELD

The present disclosure relates generally to mixing of substances, and, more particularly, to assemblies, methods, and devices for mixing substances using impellers.

BACKGROUND

Plastic drums are often used to ship and store various materials, such as liquid materials used in agriculture or chemical industry. Filling these materials may be time-consuming and labor-intensive processes because drum fitments are required to be installed on site before filling begins. In addition, because liquid materials are expensive, it is important that all the contents of the drum are removed before the drum is discarded or returned, to eliminate waste. One method of emptying completely the contents of a plastic drum would be to turn the drum upside down. However, this procedure may be time-consuming and requires special equipment. Moreover, if the drum contains hazardous materials, turning the drum over may result in a spill, which may be both uneconomical and undesirable.

U.S. Patent Application Publication No. 2010/0195432 discloses a cover of a container having a central opening for inserting a shaft of an electric hand drill for mixing, a peripheral opening used as pouring spout to dispense materials, and a pair of additional openings, into which a vacuum hose may be inserted to evacuate dust, such as plaster, cement, and the like.

U.S. Pat. No. 6,047,846 discloses plastic drums having a pair of access holes and sloping bottom with a sump aligned with the access hole to allow, substantially, all the contents of the drum to be removed without turning the body upside down.

U.S. Pat. No. 9,713,799 discloses a mixing device having a base, shaft, impeller sleeve, and impeller blades. The base can be constructed for releasable attachment to an opening of a container, such as a 55-gallon drum. The shaft extends from the base and may be coupled thereto such that rotation can be transmitted to the shaft by way of or through the base. The impeller sleeve may be mounted on the shaft and supports the impeller blades. Each impeller blade includes an attachment leg and a stirring leg extending from the attachment leg. The impeller blades are supported so as to transition from a collapsed position with the stirring leg proximal to a central axis of the shaft to an extended position with the stirring leg distal from the central axis when the shaft is rotated. The impeller can be mounted on a shaft coupled to the base and can support the blades to allow displacement of the blades from a collapsed position to an extended position upon rotation of the shaft. The collapsed position can allow the impeller to fit through the relatively narrow opening, e.g., 2-inch in diameter, of the container, while the extended position allows for effective stirring of the substance of the container.

There is a need in the art for a drum, e.g., plastic drum, that allows for efficient mixing of chemicals and can be filled and emptied efficiently.

SUMMARY

One embodiment in accordance with the present disclosure relates to a mixing assembly, including: a drum including: a side wall, a top portion, and a bottom portion, in which the top portion includes a first opening for filling a substance into the drum, a second opening for mixing the substance in the drum, and a third opening for extracting the substance from the drum; in which the bottom portion includes a sump that may be substantially vertically aligned with the third opening for extracting, in which the bottom portion may be sloped toward the sump so that the substance will flow along the sloped bottom portion into the sump, in which the sump includes a base defining a lowest surface of the bottom portion so that the sump will receive the substance that flows from the sloped bottom portion, a suction pipe disposed in the drum, in which a top end of the pipe may be connected with a valve that may be releasably attached to the third opening for extracting, in which a bottom end of the pipe may be received in the sump and disposed proximate the base of the sump, and in which the valve may be adapted to be coupled with a pump for substantially completely extracting the substance from the sump through the pipe by suction; and a mixer releasably disposed in the drum, including: a head releasably attached to the second opening for mixing, in which the head includes a housing including an internal hollow region extending along the central axis of the head, and external threads configured to be attached to the second opening for mixing by thread engagement, a shaft disposed in the hollow region, in which a top end of the shaft may be coupled to the head such that rotation may be transmitted to the shaft by way of or through the head, and an impeller assembly disposed at a bottom end of the shaft for stirring the substance in the drum.

Another embodiment in accordance with the present disclosure relates to a drum including: a side wall, a top portion, and a bottom portion, in which the top portion includes a first opening for filling a substance into the drum, a second opening for mixing the substance in the drum, and a third opening for extracting the substance from the drum; in which the bottom portion includes a sump that may be substantially vertically aligned with the third opening for extracting, in which the bottom portion may be sloped toward the sump so that the substance will flow along the sloped bottom portion into the sump, and in which the sump includes a base defining a lowest surface of the bottom portion so that the sump will receive the substance that flows from the sloped bottom portion.

Another embodiment in accordance with the present disclosure relates to a mixer for mixing a substance in a drum, including: a head including a housing including an internal hollow region extending along the central axis of the head, and external threads configured to be attached to an opening of the drum by thread engagement, a cap, and a plug, and a shaft disposed in the internal hollow region of the head, in which the housing may be configured to receive the cap that may be configured to receive the plug such that the rotation may be transmitted to the shaft by engaging the plug with a rotation source, in which a top end of the shaft may be coupled to the head such that rotation may be transmitted to the shaft by way of or through the head, and an impeller assembly disposed at a bottom end of the shaft for stirring the substance in the drum.

Other objects and advantages of embodiments of the disclosed subject matter will become apparent from the following description when considered in conjunction with the accompanying drawings.

BRIEF DESCRIPTION OF THE SEVERAL VIEWS OF THE DRAWINGS

The nature and mode of the operation of the present invention will now be more fully described in the following detailed description of the invention taken with the accompanying drawing Figures, in which.

DETAILED DESCRIPTION

Figure 1:
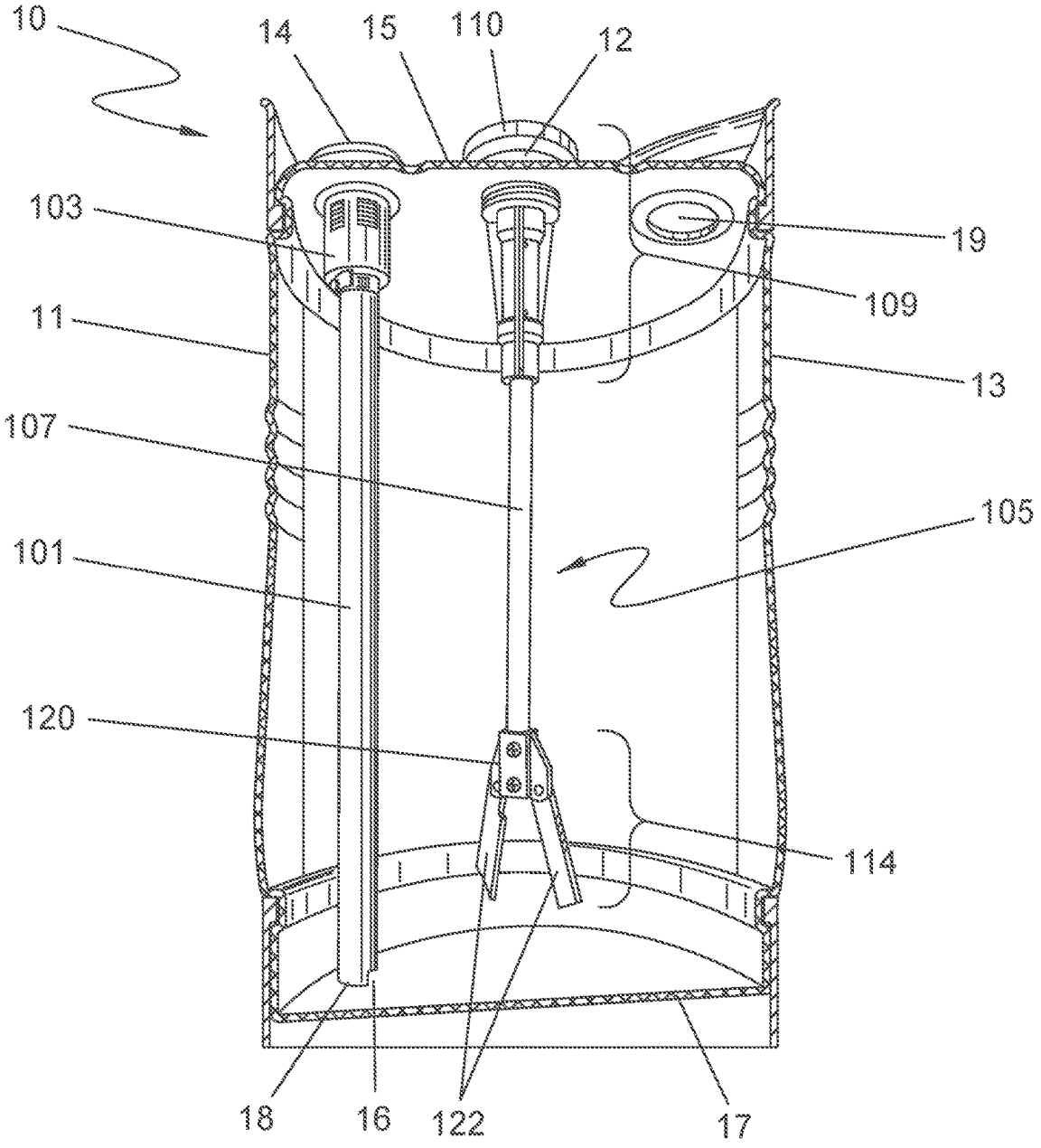
FIG. 1 shows a cross section view of a mixing assembly in accordance with one embodiment of the present disclosure.

Industrial drums normally have two top openings. Filling conventional drums, e.g., 56.78 liters (15 gallon) 2-bung drums, with heterogeneous mixture prone to separation of component ingredients, e.g., seed treatment products, may be a time-consuming process because operators may need to install various drum fitments, such as valves and stirrer/mixer, on these drums before filling begins. While continuous extrusion blow molding may be used to make industrial drums, collapsing blow pin technology may be used to make three-opening drums of the present disclosure.

Advantages of the present disclosure, as compared with conventional mixing assemblies with 2-bung drums, may include (1) improved efficiency during filling by using 3-bung drums, in which valves and stirrer/mixer can come pre-installed, i.e., operators can simply fill heterogeneous mixture, e.g., seed treatment product, through the third opening and quickly apply a standard easy-to-install bung fitting; (2) improved drum evacuation and cost saving by increasing slope on the bottom of drum towards a sump, thus, there may be no need to over-fill drums to ensure the requested amount of product may be delivered, i.e., cost savings; and (3) improved sustainability and cost saving by reducing weight of 3-bung drums of the present disclosure, e.g., from about 10 lbs (4.54 kg) to about 20 lbs (9.07 kg), preferably, less than about 15.0 lbs (6.80 kg), less than about 14.0 lbs (6.35 kg), less than about 13.0 lbs (5.90 kg), or less than about 12.0 lbs (5.44 kg), such as 11.65 lbs. (5.28 kg) per drum excluding fitments compared with conventional 2-bung drums, e.g., 16.1 lbs. (7.30 kg) per drum excluding fitments, i.e., 3-bung drum of the present disclosure may be 4.45 lbs. (2.02 kg) per drum lighter than conventional 2-bung drum. Therefore, 3-bung drums of the present disclosure may be used for recyclable content and have lower part weight and the ability for automatic chemical filling systems to remove nearly all of the product out of the drums.

FIG. 1 shows a mixing assembly 10 according to one embodiment of the invention. Mixing assembly 10 may include drum 11, e.g., flexible drum, which may include side wall 13, e.g., cylindrical side wall, top portion 15, and bottom portion 17. Top portion 15 may include opening 19 for filling substance (not shown), which may include heterogeneous mixture prone to separation of component ingredients, e.g., seed treatment products, into drum 11, opening 12 (see also FIG. 2) for mixing substance in drum 11, and opening 14 (see also FIG. 2) for extracting substance from drum 11.

Figure 2:
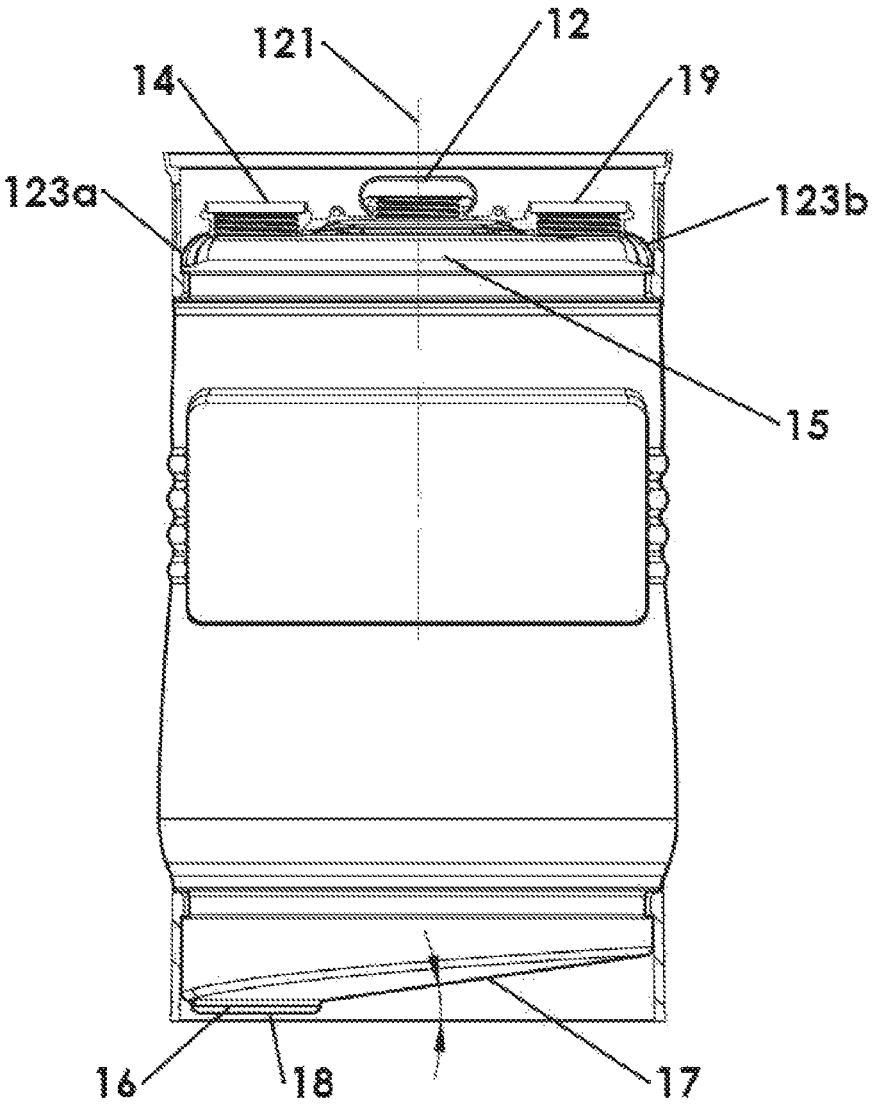
FIG. 2 shows a cross section view of a drum in accordance with one embodiment of the present disclosure.

FIG. 2 shows, according to one embodiment of the invention, opening 12 for mixing may be disposed substantially vertically aligned with the central axis 121 of top portion 15. Opening 14 for extracting may be disposed closer to periphery 123*a* of top portion 15 than to the central axis 121 of top portion 15. Similarly, opening 19 for filling may be disposed closer to periphery 123*b* of top portion 15 than to the central axis 121 of top portion 15.

FIG. 2 shows, according to one embodiment of the invention, bottom portion 17 may include sump 16 that may be substantially vertically aligned with opening 14 for extracting. Bottom portion 17 may be sloped, e.g., having an angle $\alpha$ from 1°-15°, preferably 8°, toward sump 16 so that substance, e.g., a product for treatment of seeds (not shown), may flow along sloped bottom 17 into sump 16. Sump 16 may have base 18, which may define a lowest surface of bottom portion 17, so that sump 16 may receive substance flowing from sloped bottom portion 17.

Drums of the present disclosure may have at least three bungs, e.g., 3-bung, 4-bung, 5-bung, and 6-bung, preferably 3-bung drums, and may be of any desired size or shape, including, for example, from 2-gallon (7.6 liters) to 5-gallon (18.9 liters), from 2-gallon (7.6 liters) to 15-gallon (56.8 liters), from 2-gallon (7.6 liters) to 30-gallon (113.6 liters), from 2-gallon (7.6 liters) to 55-gallon (208.2 liters), or from 2-gallon (7.6 liters) to 80-gallon (302.8 liters) drums with a diameter of from 30 cm to 45 cm, a height of from 50 cm to 75 cm, and a weight of from 10 lbs. (4.54 kg) to 20 lbs. (9.08 kg). Preferably, 3-bung drums of the present disclosure may be 15 gallon drums with a diameter of 38.1 cm (15 inches), a height of 66.04 cm (26 inches), and a weight of 5.28 kg (11.65 lbs.) (excluding fittings). Drums, e.g., 3-bung drum, of the present disclosure may be made of any suitable materials, e.g., wood, plastic, and/or metals including steel, aluminum, brass, and bronze.

Table 1 shows advantages of drums, according to one embodiment of the invention, e.g., 15 gallon 3-bung drum with a diameter of 38.1 cm (15 inches), a height of 66.04 cm (26 inches), and a weight of 5.28 kg (11.65 lbs.) (excluding fittings), in comparison with conventional 15 gallon 2-bung drum with a diameter of 49.0 cm (19.3 inches), a height of 50.5 cm (19.9 inches), and a weight of 7.30 kg (16.1 lbs.) (excluding fittings) in palletization for transport.

TABLE 1

| Conventional 2-Bung Drum | 3-bung drums of the present disclosure |
|---|---|
| 5 drums per pallet (with overhang) | 9 drums per pallet (without overhang) |

TABLE 1-continued

| | |
|---|---|
| Stack 3-level high in warehouse = 15 drums | Stack 3-level high in warehouse = 27 drums |
| Stack 2-level high in truck = 10 drums | Stack 2-level high in truck = 18 drums |
| Cube out truck (260 drums per truck) 52 pallets | Weigh out truck (342 drums per truck) 38 pallets |

Due to greater height and less diameter per drum, drums, e.g., 3-bung drums, of the present disclosure than that of conventional 2-bung drums, 3-bung drums according to one embodiment of the invention may require less storage or warehouse space and may increase the number of drums per truckload, as compared with that of conventional 2-bung drums. For example, 4 more 3-bung drums of the present disclosure (9 drums per pallet) than convention 2-bung drums (5 drums per pallet) may be loaded. When stacked 3-level high in warehouse, this increased cube efficiency may result in 12 more 3-bung drums of the present disclosure (27 drums per stack) than convention 2-bung drums (15 drums per stack). When stacked 2-level high in truck, this increased cube efficiency may result in 8 more 3-bung drums of the present disclosure (18 drums/2 pallets per stack) than convention 2-bung drums (10 drums/2 pallets per stack). Thus, for weight out truck, 82 more 3-bung drums of the present disclosure (342 drums (=9 drums×38 pallets (19 stacks)) per truckload may be transported than convention 2-bung drums (260 drums (=5 drums×52 pallets (26 stacks)) per truckload. In contrast, for cube out truck, because there may be no overhang for drums, e.g., 3-bung drum, of the present disclosure on pallets, approximately 28 stacks (56 pallets) may be loaded per truck, i.e., 504 drums (=9 drums/pallet×56 pallets) per truckload may be loaded, as compared with 260 drums (=5 drums/pallet×52 pallets) per truckload of conventional 2-bung drums loaded on pallets with overhang.

FIG. 1 shows, according to one embodiment of the invention, suction pipe 101 disposed in drum 11. A top end of pipe 101 may be attached with and in fluid communication with valve 103 that may be releasably attached to opening 14 for extracting. A bottom end of pipe 101 may be received in sump 16 and disposed proximate base 18 (see also FIG. 2) of sump 16. Valve 103 may be adapted to be coupled with pump, e.g., sump pump (not shown), for substantially completely extracting substance from sump 16 through pipe 101 by suction. Valve 103 may be made of any suitable materials including plastic materials. For example, valve 103 may be a polyethylene valve with Viton gasket for single-use, i.e., no need to reclaim used drums to recover valve 103. Advantages of using polyethylene valve may include reducing manufacturing costs and increasing efficiency of a one way single trip container system.

FIG. 1 shows, according to one embodiment of the invention, mixing assembly 10 may also include mixer 105 (see also FIG. 3) releasably disposed in drum 11. Mixer 105 may include head 109 (see also FIG. 4) releasably attached to opening 12 for mixing. Suction pipe 101, valve 103, mixer 105 may be pre-installed in drum 11 for single-use, i.e., no need to reclaim used drums to recover suction pipe 101, valve 103, and mixer 105.

Figure 4:
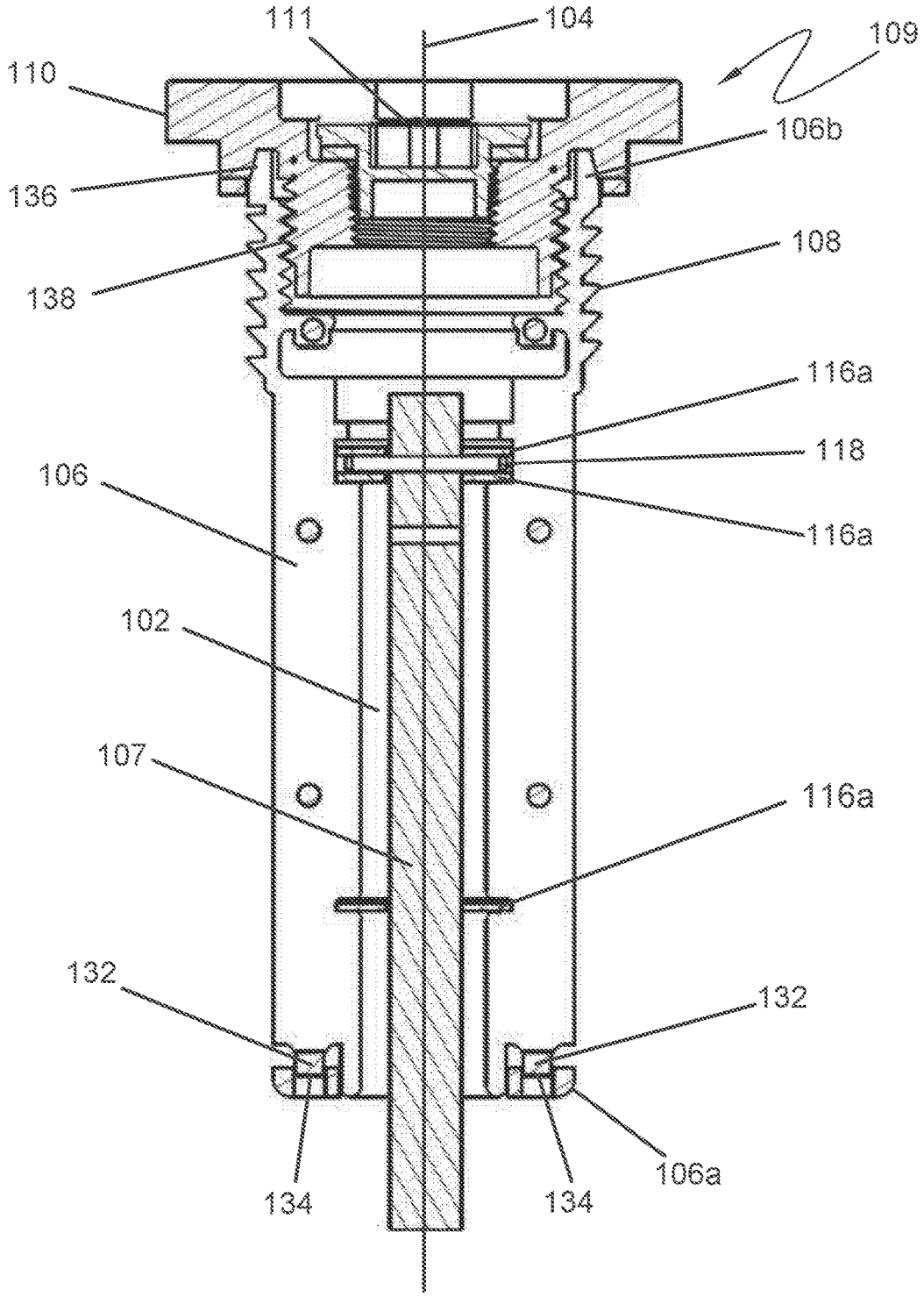
FIG. 4 is a cross section view of a head of mixer in accordance with one embodiment of the present disclosure.

FIG. 4 shows, according to one embodiment of the invention, head 109 may include housing 106 having internal hollow region 102 extending along the central axis 104 of head 109. Shaft 107 may be disposed in hollow region 102, in which a top end of shaft 107 may be coupled to head 109 such that rotation may be transmitted to shaft 107 by way of or through head 109. Head 109 may have at least one shaft ring 116*a* disposed in hollow region 102 for disposing shaft 107 therethrough and at least one fastener 118, e.g., roll pin, disposed substantially perpendicular to the central axis of 104 through shaft 107 for positioning shaft 107 in hollow region 102. Shaft 107 may have any suitable cross-sectional shape, e.g., rectangular, circular, elliptical, triangular, and polygonal.

Head 109, according to one embodiment of the invention, may include housing 106 that may be attached to opening 12 for mixing by any suitable means, such as by thread engagement with external threads 108. Housing 106 may contain taper regions 136 disposed on top portions of external tread 108 configured for self-locking bung. Housing 106 may be formed as a unitary part or multiple parts, e.g., two separable halves. For example, FIG. 4 shows housing 106 may be formed by a first separable portion and a second separable portion along the longitudinal axis 104 of head 109, in which the first separable portion containing protrusions 132 and the second separable portion containing inner recesses 134 disposed at lower ends 106*a* of housing 106. The first separable portion and the second separable portion may be two separable halves. FIG. 4 shows a cross-section view of the first separable portion. The second separable portion is on the opposite side of the first half portion and is not completely shown in FIG. 4. Protrusions 132 may engage inner recesses 134 to latch the first separable portion to the second separable portion to form hinges, e.g., clamshell hinges, such that the first separable portion and the second separable portion rotate to enclose a portion of shaft 107 within internal hollow region 102 of housing 106.

Head 109 may also include cap 110 and plug 111. Housing 106 may have a top opening with internal means of engagement 138 configured to receive cap 110 by any suitable means, e.g., thread engagement. Housing 106 may be formed by two separable halves. In this configuration, engagement of cap 110 at upper ends 106*b* of housing 106 may further stabilize housing 106. Cap 110 may have a top opening configured to receive plug 111 by any suitable means, e.g., thread engagement, such that rotation may be transmitted to shaft 107 by engaging plug 111 using any suitable rotation sources, e.g., manual rotation by hand, e.g., using crank, or mechanical rotation by using motor or drill.

Figure 5A:
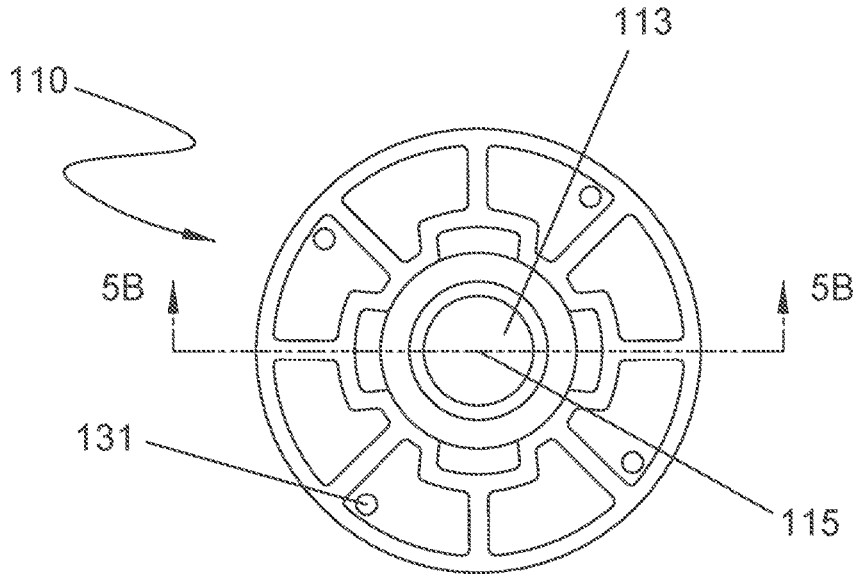
FIG. 5A shows a top view of a cap in accordance with one embodiment of the present disclosure.

FIG. 5A shows, according to one embodiment of the invention, a top view of cap 110. Cap 110 may have channel 113 disposed therethrough the central axis 115 of cap 110. Cap 110 may contain holes 131 as tamper evidence for securing to drum with cables. For example, holes 131 may be molded into drum beside neck opening. Holes 131 may be used with wire seals to secure part to drum. Wire seals may be heavy seals that may be cut off with cutting devices, such as dikes. When sealed, cable tie or similar tamper proof seal may be installed through drum and closure such that closure may not be removed without destroying cable tie/seal indicating tampering.

Figure 5B:
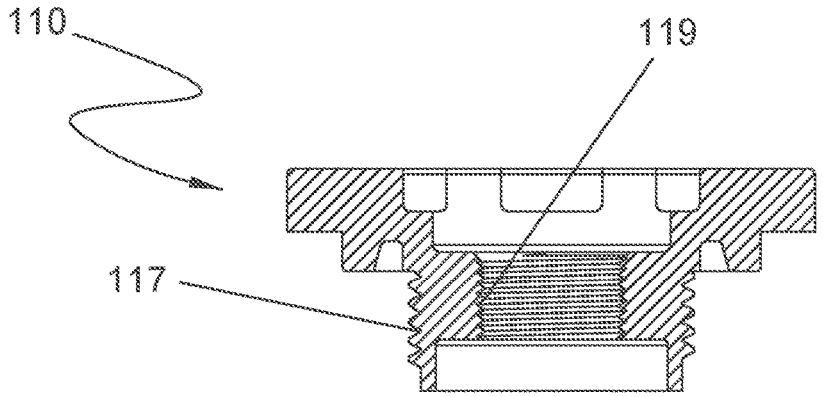
FIG. 5B is a cross section view along line 5B-5B of the cap shown in FIG. 5A.

FIG. 5B shows a cross-section (A-A) view of cap 110 shown in FIG. 5A. Cap 110 may be attached with a top opening of head 109 by any suitable means, e.g., by thread engagement with external threads 117. Channel 113 of cap 110 may be configured to receive plug 111 by any suitable means, e.g., by thread engagement with internal threads 119.

Figure 6:
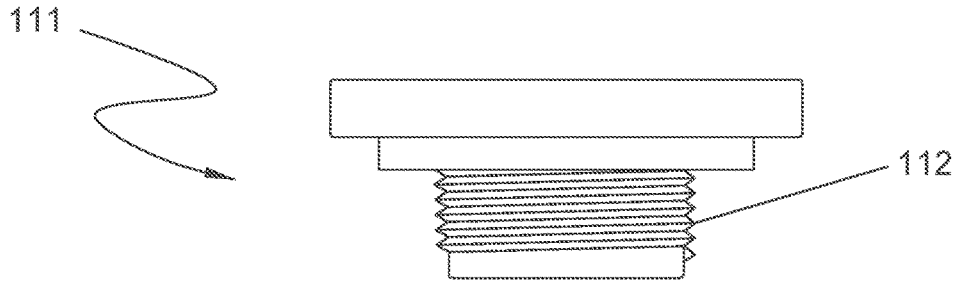
FIG. 6 shows a side view of a plug in accordance with one embodiment of the present disclosure.

FIG. 6 shows, according to one embodiment of the invention, plug 111, which may be configured to attached to cap 110 by any suitable means, e.g., by thread engagement between threads 112 and internal threads 119 of channel 113.

Figure 7:
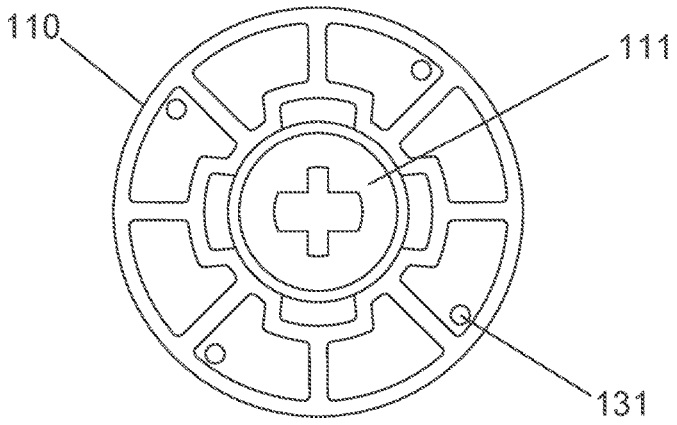
FIG. 7 shows a top view of a plug engaged with a cap in accordance with one embodiment of the present disclosure.

FIG. 7 shows a top view, according to one embodiment of the invention, when cap 110 and plug 111 are attached to each any suitable means, e.g., by thread engagement. Cap 110 may contain holes 131 for securing to drum with cables.

Mixer of the present disclosure may be made of any suitable materials, e.g., wood, plastic, and/or metals including steel, aluminum, brass, and bronze and of any desired styles, e.g., straight or slanted, when disposed inside drums. More than one mixer may be used in each drum.

Figure 3:
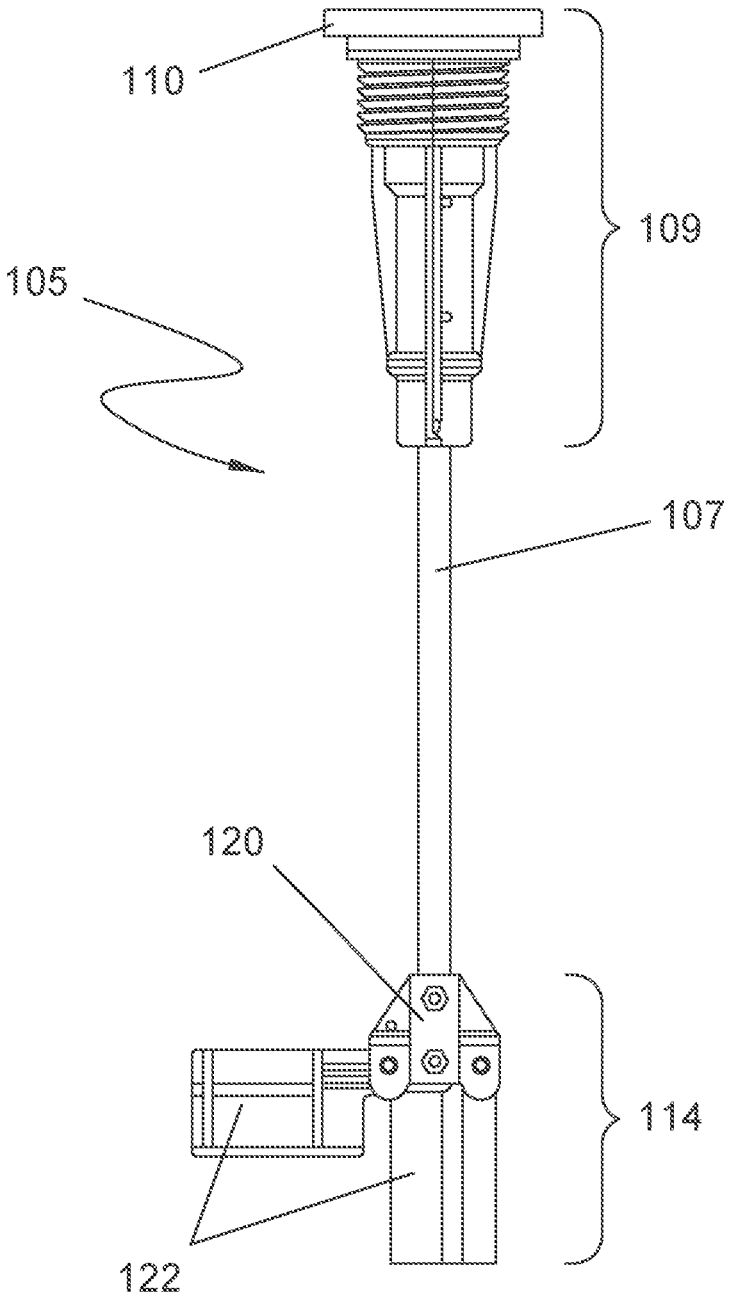
FIG. 3 shows a front view of a mixer in accordance with one embodiment of the present disclosure.

FIGS. 1 and 3 show, according to one embodiment of the invention, mixer 105 may have impeller assembly 114 disposed at a bottom end of shaft 107 for stirring substance in drum 11. Impeller assembly 114 may have at least one impeller sleeve 120 mounted on shaft 107 and at least one first impeller blade 122.

Figure 8A:
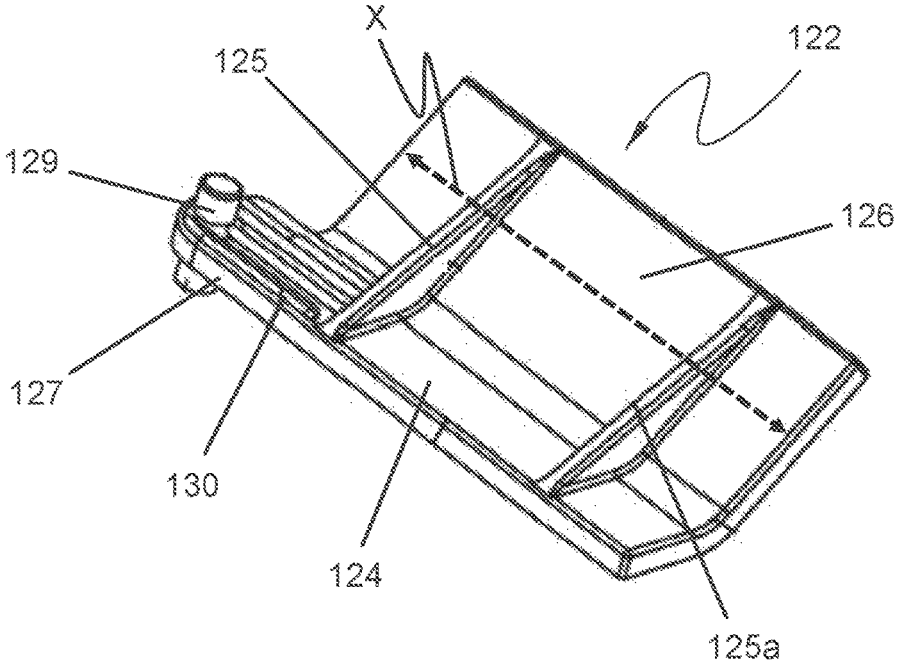
FIG. 8A is a top perspective view of an impeller blade in accordance with one embodiment of the present disclosure.
Figure 8B:
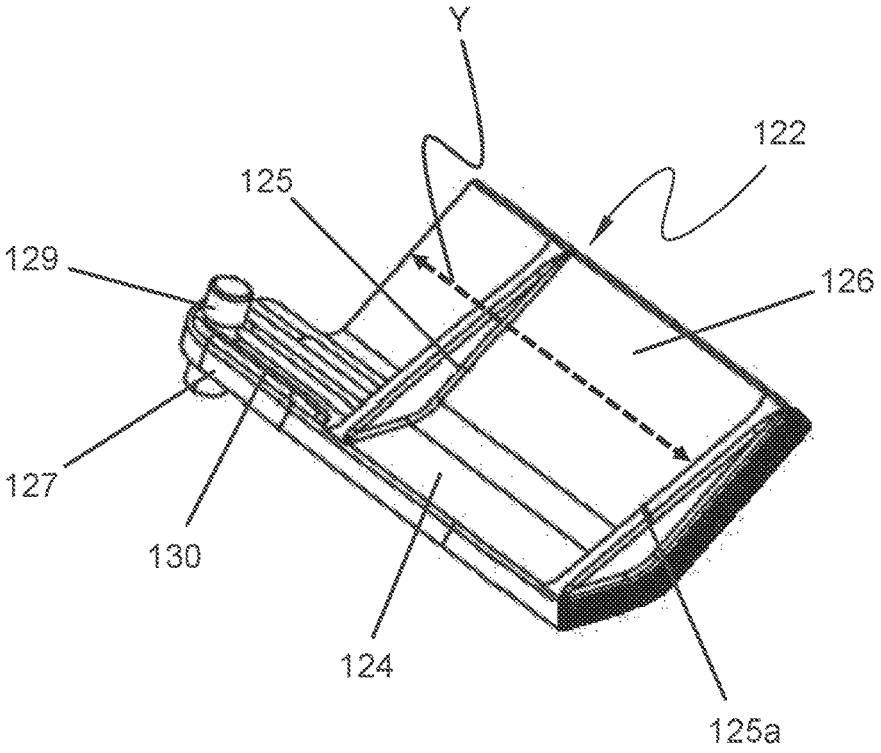
FIG. 8B is a top perspective view of an alternate embodiment of the impeller blade of the present disclosure.
Figure 9:
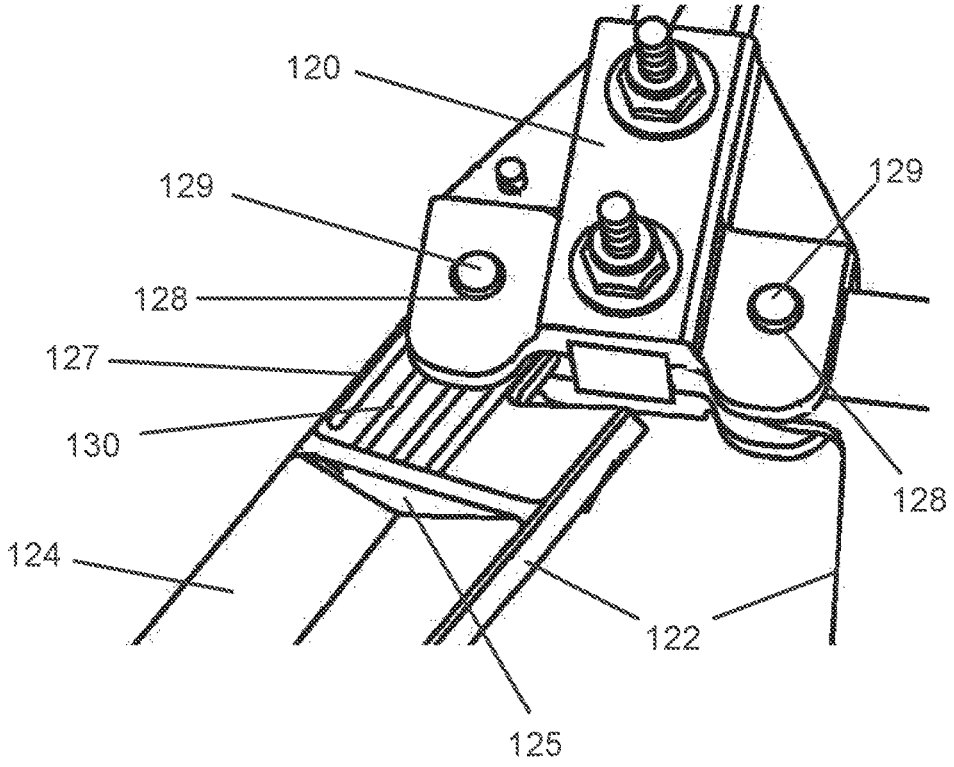
FIG. 9 is a top perspective view of an impeller blade attached with an impeller sleeve in accordance with one embodiment of the present disclosure.

FIGS. 8A, 8B, and 9 show, according to one embodiment of the invention, impeller blade 122 may have attachment leg 124 and stirring leg 126 extending from attachment leg 124. FIG. 8A shows at least one impeller blade 122 may have any suitable length X. For example, attachment leg 124 and stirring leg 126 may extend from attachment portion 127 and end beyond support rib 125*a*. Impeller blade 122, however, may not have support ribs or may include any number of ribs, for example, at least one support rib 125, 125*a* extending from a face of stirring leg 126. Attachment leg 124 of at least one impeller blade 122 may have attachment portion 127 disposed proximally to impeller sleeve 120 with at least one bushing 129 extending from a surface or opposite surfaces thereof. Bushing 129 may be constructed to allow at least one impeller blade 122 to rotate from the collapsed position to the extended position (see FIGS. 10A and 10B). FIG. 8B shows, alternatively, impeller blade 122 may have shorter length Y than length X shown in FIG. 8A. For example, attachment leg 124 and stirring leg 126 may extend from attachment portion 127 and end at support rib 125*a*. Advantages of mixer 105 having shorter blades 122 may include the use of mixer 105 in drums with only two openings on top portions, improved assembly efficiency, and the use of mixer 105 with manual or mechanical mixing devices. Installing conventional mixers to drums may be a time-consuming process, for example, in three steps: inserting housing, turning housing until blades are pointing to the middle of drum, and then applying collar and cap. In contrast, installing mixers of the present disclosure to drums may be simply performed by inserting mixer into bung hole and tightening mixer to certain torque. Thus, other advantages of using mixer in accordance with one embodiment of the present disclosure may include improvement of mixer installation by eliminating the need to turn housing to drum as well as eliminating the installation of collar, and removing a second sealing surface (cap to collar).

Regions of impeller blade 122, according to one embodiment of the invention, subject to higher stress concentrations may be reinforced with stronger materials, e.g., made of increased thickness, or including an array of ribs. For example, attachment portion 127 may have a thickness greater than that of other regions of attachment leg 124. In other embodiments, attachment portion 127 may include a plurality of ribs 130 disposed proximally to impeller sleeve 120 to reinforce impeller blades 122 at its point of attachment, i.e., bushing 129 that may interface with at least one opening or recess 128 in impeller sleeve 120. Ribbed region may cover, for example, attachment portion 127 of attachment leg 124. Ribs 130 may be configured not to extend past support rib 125. In some embodiments, however, ribs 130 may extend beyond support rib 125 or even the entire length of attachment leg 124, e.g., contacting rib 125*a*. Each rib 130 may extend longitudinally, i.e., along the elongation direction of attachment leg 124, which may be perpendicular to, or at least crossing, a direction of extension of support rib 125. In some embodiments, each rib 130 may extend parallel to the elongation direction, whereas in other embodiments, each rib 130 may extend mainly along (e.g., at an angle less than 10° with respect to) the elongation direction. Although FIG. 9 shows ribs 130 may be disposed on only a single side of attachment portion 124, it may be contemplated that ribs 130 may also be provided on either or both sides of attachment portion 124.

Figure 10A:
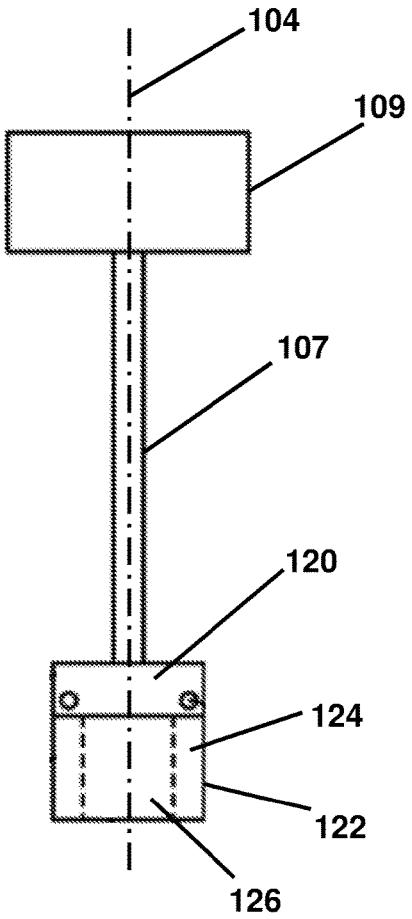
FIG. 10A is a side schematic view of the impeller blades attached to the impeller sleeve in a collapsed position in accordance with one embodiment of the present disclosure.
Figure 10B:
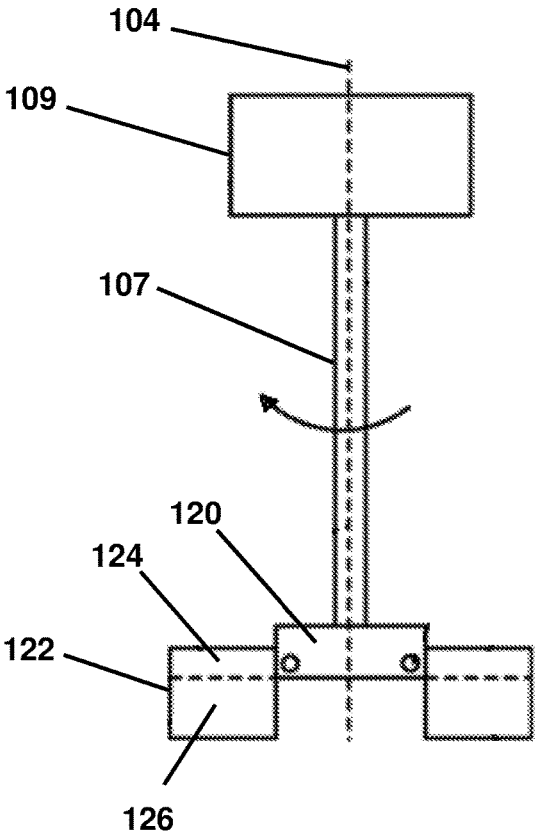
FIG. 10B is a side schematic view of the impeller blades attached to the impeller sleeve in an extended position in accordance with one embodiment of the present disclosure.

FIGS. 10A and 10B show, according to one embodiment of the invention, at least one first impeller blade 122 may be supported by at least one impeller sleeve 120 to transition from a collapsed position (FIG. 10A) with stirring leg 126 proximal to the central axis 104 of head 109 to an extended position (FIG. 10B) with stirring leg 126 distal from the central axis 104 when shaft 107 is rotated, e.g., in clockwise direction. However, in other embodiments, impeller blade 122 may be fixed, e.g., not collapsible, at an extended position (FIG. 10B) without the rotation of shaft 107. For example, impeller blade 122 may be fixedly attached to impeller sleeve 120, e.g., impeller blade 122 may be integral part of impeller sleeve 120 and/or shaft 107, at an extended position.

Figure 11:
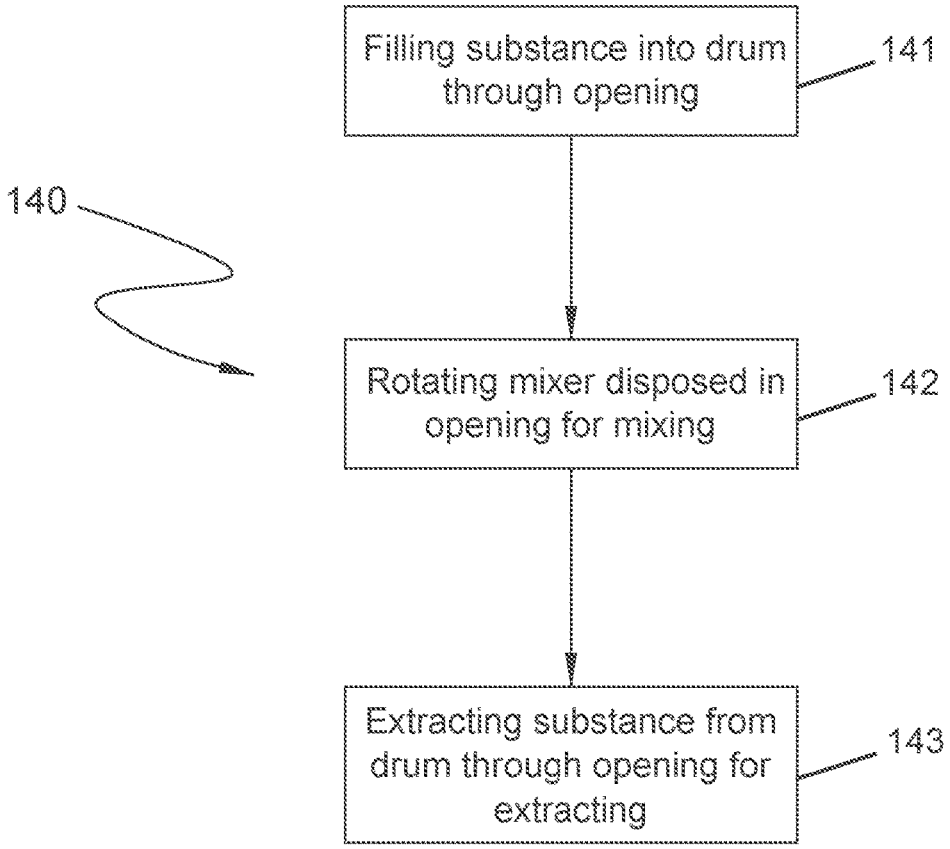
FIG. 11 is a flow diagram depicting a method of filling, mixing, and extracting a substance in accordance with one embodiment of the present disclosure.

FIG. 11 shows, according to one embodiment of the invention, method (140) of mixing substance, such as heterogeneous mixture prone to separation of component ingredients, e.g., product for treatment of seeds, in mixing assembly, in which valve, suction pipe, and mixer may be pre-installed in drum, e.g., flexible drum. Method (140) may include filling substance into drum through opening for filling (141), rotating mixer disposed in opening for mixing (142), and, optionally, removing substance from drum through opening for extracting (143).

Features of the disclosed embodiments may be combined, rearranged, omitted, etc., within the scope of the invention to produce additional embodiments. Furthermore, certain features may sometimes be used to advantage without a corresponding use of other features.

It is thus apparent that there is provided in accordance with the present disclosure, system, methods, and devices for mixing a substance using any impellers including extendible or not collapsible impellers. Many alternatives, modifications, and variations are enabled by the present disclosure. While specific embodiments have been shown and described in detail to illustrate the application of the principles of the present disclosure, it will be understood that the invention may be embodied otherwise without departing from such principles. Accordingly, Applicants intend to embrace all such alternatives, modifications, equivalents, and variations that are within the spirit and scope of the present disclosure.

The invention claimed is:

1. A mixing assembly, comprising:

a drum comprising:

a side wall, a top portion, and a bottom portion, wherein the top portion comprises a first opening for filling a substance into the drum, a second opening for mixing the substance in the drum, and a third opening for extracting the substance from the drum;

wherein the bottom portion comprises a sump that is substantially vertically aligned with the third opening for extracting, wherein the bottom portion is sloped toward the sump so that the substance will flow along the sloped bottom portion into the sump, wherein the sump comprises a base defining a lowest surface of the bottom portion so that the sump will receive the substance that flows from the sloped bottom portion, a suction pipe disposed in the drum, wherein a top end of the suction pipe is connected with a valve positioned within the drum that is releasably attached to the third opening for extracting, wherein a bottom end of the pipe is received in the sump and disposed proximate the base of the sump, and wherein the valve is adapted to be coupled with a pump for substantially completely extracting the substance from the sump through the pipe by suction; and a mixer releasably disposed in the drum, comprising:

a head releasably attached to the second opening for mixing, wherein the head comprises a housing comprising an internal hollow region extending along the central axis of the head, and external threads configured to be attached to the second opening for mixing by thread engagement, a shaft disposed in the hollow region, wherein a top end of the shaft is coupled to the head such that rotation is transmitted to the shaft by way of or through the head, and an impeller assembly disposed at a bottom end of the shaft for stirring the substance in the drum.

2. The mixing assembly of claim 1, wherein the head further comprises a cap and a plug, wherein the housing is configured to receive the cap that is configured to receive the plug such that the rotation is transmitted to the shaft by engaging the plug with a rotation source.

3. The mixing assembly of claim 1, wherein the head further comprises at least one shaft ring for disposing the shaft therethrough.

4. The mixing assembly of claim 1, wherein the head further comprises at least one fastener for positioning the shaft.

5. The mixing assembly of claim 1, wherein the suction pipe, the valve, and the mixer are pre-installed in the drum.

6. The mixing assembly of claim 1, wherein the rotation is provided manually or mechanically.

7. The mixing assembly of claim 1, wherein the pump is a sump pump.

8. The mixing assembly of claim 1, wherein the second opening for mixing is disposed substantially vertically aligned with the central axis of the top portion.

9. The mixing assembly of claim 1, wherein the third opening for extracting is disposed closer to a periphery of the top portion than to the central axis of the top portion.

10. The mixing assembly of claim 1, wherein the first opening for filling is disposed closer to a periphery of the top portion than to the central axis of the top portion.

11. The mixing assembly of claim 1, wherein the impeller assembly comprises at least one impeller sleeve mounted on the shaft; and at least one first impeller blade comprising an attachment leg and a stirring leg extending from the attachment leg, wherein the at least one first impeller blade is supported by the at least one impeller sleeve so as to transition from a collapsed position with the stirring leg proximal to a central axis of the shaft to an extended position with the stirring leg distal from the central axis when the shaft is rotated, wherein each first impeller blade comprises a plastic material.

12. The mixing assembly of claim 11, wherein the at least one impeller blade comprises at least one support rib extending from a face of the stirring leg.

13. The mixing assembly of claim 11, wherein the attachment leg of the at least one impeller blade comprises an attachment portion with at least one bushing extending from a surface or opposite surfaces thereof, wherein the at least one impeller sleeve comprises at least one hole or recess that receives the at least one bushing, and the at least one hole or recess and the at least one bushing are constructed to allow the at least one impeller blade to rotate from the collapsed position to the extended position.

14. A method of mixing a substance in the mixing assembly of claim 1, comprising filling the substance into the drum through the first opening for filling, and rotating the mixer disposed in the second opening for mixing.

15. The method of claim 14, further comprising removing the substance from the drum through the third opening for extracting.

16. A drum comprising:

a side wall, a top portion, and a bottom portion, wherein the top portion comprises a first opening for filling a substance into the drum, a second opening for mixing the substance in the drum, and a third opening for extracting the substance from the drum;

wherein the bottom portion comprises a sump that is substantially vertically aligned with the third opening for extracting, wherein the bottom portion is sloped toward the sump so that the substance will flow along the sloped bottom portion into the sump;

wherein the sump comprises a base defining a lowest surface of the bottom portion so that the sump will receive the substance that flows from the sloped bottom portion; and, a suction pipe disposed in the drum;

wherein a top end of the pipe is connected with a valve positioned within the drum and releasably attached to the third opening for extracting, wherein a bottom end of the pipe is received in the sump and disposed proximate the base of the sump, and wherein the valve is adapted to be coupled with a pump for substantially completely extracting the substance from the sump through the pipe by suction.

17. A mixing assembly, comprising:

a drum comprising:

a side wall, a top portion, and a bottom portion, wherein the top portion comprises a first opening for filling a substance into the drum, a second opening for mixing the substance in the drum, and a third opening for extracting the substance from the drum;

wherein the bottom portion comprises a sump that is substantially vertically aligned with the third opening for extracting, wherein the bottom portion is sloped toward the sump so that the substance will flow along the sloped bottom portion into the sump, wherein the sump comprises a base defining a lowest surface of the bottom portion so that the sump will receive the substance that flows from the sloped bottom portion, a suction pipe disposed in the drum, wherein a top end of the pipe is connected with a valve that is releasably attached to the third opening for extracting, wherein a bottom end of the pipe is received in the sump and disposed proximate the base of the sump, and wherein the valve is adapted to be coupled with a pump for substantially completely extracting the substance from the sump through the pipe by suction; and a mixer releasably disposed in the drum, comprising:

a head releasably attached to the second opening for mixing, wherein the head comprises a housing comprising an internal hollow region extending along the central axis of the head, and external threads configured to be attached to the second opening for mixing by thread engagement, a cap and a plug, wherein the housing is configured to receive the cap that is configured to receive the plug such that the rotation is transmitted to the shaft by engaging the plug with a rotation source;

a shaft disposed in the hollow region, wherein a top end of the shaft is coupled to the head such that rotation is transmitted to the shaft by way of or through the head, and an impeller assembly disposed at a bottom end of the shaft for stirring the substance in the drum wherein the housing is formed by a first separable portion and a second separable portion along the longitudinal axis of the head, wherein the first separable portion comprising a protrusion and the second separable portion comprising an inner recess, wherein the protrusion engages the inner recess to latch the first separable portion to the second separable portion to form a hinge, such that the first separable portion and the second separable portion rotate to enclose a portion of the shaft within the internal hollow region of the housing.

18. The mixing assembly of claim 17 wherein the first separable portion and the second separable portion are two separable halves.

* * * * *